US008342240B2

(12) United States Patent
Richard et al.

(10) Patent No.: US 8,342,240 B2
(45) Date of Patent: Jan. 1, 2013

(54) METHOD FOR PROVIDING A TEMPORARY BARRIER IN A FLOW PATHWAY

(75) Inventors: Bennett M. Richard, Kingwood, TX (US); Paul M. McElfresh, Cypress, TX (US); Chad F. Williams, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 459 days.

(21) Appl. No.: 12/490,148

(22) Filed: Jun. 23, 2009

(65) Prior Publication Data

US 2009/0255686 A1 Oct. 15, 2009

Related U.S. Application Data

(60) Continuation-in-part of application No. 12/328,449, filed on Dec. 4, 2008, now Pat. No. 7,762,342, which is a division of application No. 10/968,534, filed on Oct. 19, 2004, now Pat. No. 7,461,699.

(60) Provisional application No. 60/513,425, filed on Oct. 22, 2003.

(51) Int. Cl.
*E21B 43/00* (2006.01)

(52) U.S. Cl. ..... 166/205; 166/377; 166/296

(58) Field of Classification Search ..... 166/205, 166/296, 300, 317, 376; 137/67, 72, 73
See application file for complete search history.

(56) References Cited

U.S. PATENT DOCUMENTS 3,057,405 A 10/1962 Mallinger
3,880,233 A * 4/1975 Muecke et al. ..... 166/205
5,224,556 A 7/1993 Wilson et al.
5,287,923 A 2/1994 Cornette et al.
5,320,178 A 6/1994 Cornette
6,059,032 A 5/2000 Jones (Continued)

FOREIGN PATENT DOCUMENTS

GB 728197 4/1955

(Continued)

OTHER PUBLICATIONS

Cargill Dow LLC; "PLA Polymer 4060D—A NatureWorks Product," Production Information Brochure, Oct. 2002, 2 pp.

(Continued)

*Primary Examiner* — William P Neuder
*Assistant Examiner* — Yong-Suk Ro
(74) *Attorney, Agent, or Firm* — Mossman Kumar & Tyler PC

(57) ABSTRACT

A flow conduit may have at least one orifice, which conduit is in the vicinity of a flow source. The source is at least partially covered (and flow blocked by) an optional temporary coating or barrier (e.g. filter cake). The flow pathway between the orifice and the source is temporarily blocked with a degradable material. A delayed degradation material layer is present over or covering the degradable material. The delayed degradation material layer degrades at a rate slower than the degradable barrier. The degradable material and delayed degradation material layer disintegrate (e.g. via time, temperature, a solvent). The degradable material optionally produces a product that removes the temporary coating. The method is useful in one context of recovering hydrocarbons where the flow conduit is the casing or liner of the well and the flow source is a subterranean reservoir where the coating is filter cake.

23 Claims, 2 Drawing Sheets

U.S. PATENT DOCUMENTS

| | | | |
|---|---|---|---|
| 6,394,185 | B1 | 5/2002 | Constien |
| 6,543,539 | B1 | 4/2003 | Vinegar et al. |
| 6,543,545 | B1 | 4/2003 | Chatterji et al. |
| 6,818,594 | B1 | 11/2004 | Freeman et al. |
| 6,831,044 | B2 | 12/2004 | Constien |
| 2004/0231845 | A1 | 11/2004 | Cooke, Jr. |
| 2005/0056425 | A1 | 3/2005 | Grigsby et al. |
| 2005/0065037 | A1 | 3/2005 | Constien |
| 2007/0225175 | A1 | 9/2007 | Cooke, Jr. |
| 2008/0296024 | A1 | 12/2008 | Huang et al. |

FOREIGN PATENT DOCUMENTS

| | | | |
|---|---|---|---|
| WO | 9805734 | A1 | 2/1998 |

OTHER PUBLICATIONS

International Search Report for International Appln. No. PCT/US04/34698, Jan. 7, 2005.

* cited by examiner

METHOD FOR PROVIDING A TEMPORARY BARRIER IN A FLOW PATHWAY

CROSS-REFERENCE TO RELATED APPLICATIONS

This application is a continuation-in-part application from U.S. patent application Ser. No. 12/328,449 filed Dec. 4, 2008, which issued as U.S. Pat. No. 7,762,342 B2 on Jul. 17, 2010, which is a divisional from U.S. patent application Ser. No. 10/968,534 filed Oct. 19, 2004, which issued as U.S. Pat. No. 7,461,699 B2 on Dec. 9, 2008, which in turn claimed the benefit of U.S. provisional patent application no. 60/513,425 filed Oct. 22, 2003.

TECHNICAL FIELD

The present invention relates to methods, compositions and apparatus for temporarily blocking a flow pathway, and more particularly relates, in one non-limiting embodiment, to methods, compositions and apparatus for temporarily blocking a flow pathway to subterranean formations during hydrocarbon recovery operations that may deploy a downhole filtration tool.

BACKGROUND

There are a number of procedures and applications that involve the formation of a temporary seal, barrier or plug while other steps or processes are performed, where the seal or plug may be later removed. Often such seals, barriers or plugs are provided to temporarily inhibit or block a flow pathway or the movement of fluids or other materials, such as flowable particulates, in a particular direction for a short period of time, when later movement or flow is desirable.

A variety of applications and procedures where temporary coatings, barriers or plugs are employed are involved in the recovery of hydrocarbons from subterranean formations where operations must be conducted at remote locations, namely deep within the earth, where equipment and materials can only be manipulated at a distance. One particular such operation concerns perforating and/or well completion operations incorporating filter cakes and the like as temporary coatings.

Perforating a well involves a special gun that shoots several relatively small holes in the casing. The holes are formed in the side of the casing opposite the producing zone. These communication tunnels or perforations pierce the casing or liner and the cement around the casing or liner. The perforations go through the casing and the cement and a short distance into the producing formation. Formations fluids, which include oil and gas, flow through these perforations and into the well.

The most common perforating gun uses shaped charges, similar to those used in armor-piercing shells. A high-speed, high-pressure jet penetrates the steel casing, the cement and the formation next to the cement. Other perforating methods include bullet perforating, abrasive jetting or high-pressure fluid jetting.

The characteristics and placement of the communication paths (perforations) can have significant influence on the productivity of the well. Therefore, a robust design and execution process should be followed to ensure efficient creation of the appropriate number, size and orientation of perforations. A perforating gun assembly with the appropriate configuration of shaped explosive charges and the means to verify or correlate the correct perforating depth can be deployed on wireline, tubing or coiled tubing.

It would be desirable if the communication paths of the perforations and other openings and orifices could be temporarily blocked, filled or plugged while other operations are conducted that would cause problems if the perforations, orifices or openings were left open. Such problems include, but are not necessarily limited to, undesirable leak-off of the working fluid into the formation, and possible damage to the formation.

SUMMARY OF THE INVENTION

There is provided, in one form, a downhole filtration tool that has a flow conduit with a plurality of orifices, a degradable barrier in the orifices, and a delayed degradation material layer over the degradable barrier. The degradable barrier degrades into at least one product such as an acid, a base, an alcohol, carbon dioxide and combinations thereof. The delayed degradation material layer degrades at a rate slower than the degradable barrier. Optionally, the product is capable of removing a temporary coating adjacent or nearby. In one non-limiting embodiment, the temporary coating may be a filter cake. Optionally, the product may also remove some or all materials including, but not necessarily limited to, potentially formation damaging debris left from perforating operations in case-hole completions (e.g. fragments of casing, perforating gun, etc.) and mud invasion into the formation from poor drilling mud performance.

In another non-limiting embodiment there is provided a method for temporarily blocking a flow pathway that involves providing a flow conduit in the vicinity of a flow source or target, where the flow conduit includes a plurality of orifices, a degradable barrier in the orifices, and a delayed degradation material layer covering the degradable barrier. The degradable barrier degrades into at least one product such as an acid, a base, an alcohol, carbon dioxide and combinations thereof. The delayed degradation material layer degrades at a rate slower than the degradable barrier. The method additionally involves causing the delayed degradation material layer and the degradable barrier to degrade in any order. These degradations thereby form a pathway between the orifice and the flow source or target.

In an alternate non-limiting embodiment, there is provided a method for temporarily blocking and then opening a flow path in and/or around a mechanism that involves forming a degradable barrier over at least part of a plurality of orifices in a mechanism, forming a delayed degradation material layer over the degradable barrier and at least part of the mechanism, placing the blocked or protected mechanism at a remote location, and causing or allowing the degradable barrier and the delayed degradation material layer to degrade. The mechanism could be a downhole tool and the remote location could be a subterranean reservoir downhole. The degradable barrier and/or the delayed degradation material layer could be used to protect a sensitive, fragile or delicate part of the downhole tool. The downhole tool may be a sand controlling filtration screen. Alternatively, the remote location could be a pipeline in a remote part of the world, and the mechanism could be a tool used to service the pipeline.

Figure 1:
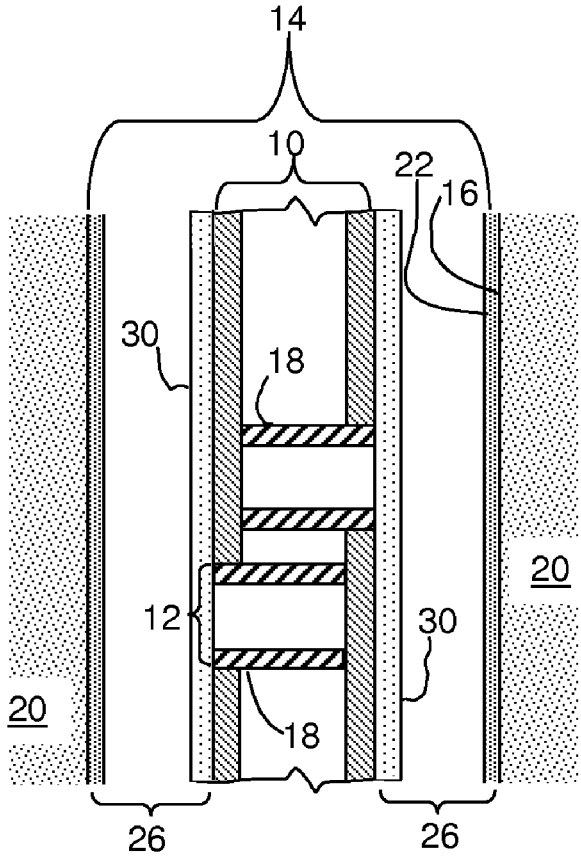
FIG. 1 is a cross-section schematic view of an oil well casing or conduit in a borehole having two degradable barriers, sleeves or tubes in contracted or indrawn position on either side of the casing, where a delayed degradation material layer is present over or covering the degradable barriers, as well as at least part of the casing and where a filter cake (temporary coating) is present on the borehole walls.

It will be appreciated that the Figures are not necessarily to scale and that the relative size and/or proportion of certain features has been exaggerated for clarity.

DETAILED DESCRIPTION

It has been discovered, in one non-limiting embodiment, that biodegradable polymers or other degradable or reactive materials may effectively serve as temporary barriers, films, coatings and the like on downhole filtration tools, such as sand control screens. Optionally, the degradable barriers may degrade, disintegrate or decompose into products that in turn can remove a temporary coating, such as a drill-in fluid filter cake breaker for oil well, gas well or injection well completion methods. However, as noted elsewhere herein, the method is not limited to this particular embodiment. For instance, the decomposition or degradation product may also subsequently remove materials including, but not necessarily limited to, formation damaging debris left from perforating operations in case-hole completions and other operations and mud placed by undesirable mud invasion due to poor drilling mud performance.

In another non-limiting form, the method may include wrapping a film of dissolvable/degradable polymer around a filtration screen or other downhole tool, then placing a protective metal shroud over the film, and sealing the tool onto the base pipe. The assembled screens would then be run into a well to a target depth, in either an aqueous- or an emulsion-based fluid. Time at the formation temperature would then cause or allow the polymer film to dissolve and/or degrade. During this process an organic acid may be released which in turn dissolves carbonaceous materials which may be contained in the filter cake on the formation. This reaction helps the well flow easier by removing plugging material from pore throats in the reservoir. After an appropriate time period (which may be up to about seven days), the well is flowed and products from dissolution and degradation are flowed through the screen and up to the surface.

In another non-restrictive version, the downhole filtration tool has a conduit or pipe bearing a plurality of orifices, which contain and/or temporarily plugged or obstructed by a degradable barrier. These degradable barriers are subsequently removed to open up flow pathways. The downhole filtration tool may additionally or alternatively have flow pathways around and/or on an exterior or within the surface of the downhole filtration tool, which pathways are temporarily blocked by degradable barriers. These degradable barriers, and optionally at least part of the flow conduit of the downhole tool, are covered or coated with a layer, film or coating of a delayed degradation material layer. That is, the delayed degradation material layer covers at least a portion of the exterior of the flow conduit, if not most or all of the downhole filtration tool. This delayed degradation material layer degrades or disintegrates at a rate slower than the degradable barrier in the orifices.

In another non-limiting embodiment of the structure and method, which may be a completion method, a barrier, collar, sleeve, plug or tube, optionally contains a specially sized gravel pack material and run on the casing or liner in place, and is placed between a filter cake or other type of coating or membrane on the borehole wall and an orifice in the casing and cemented into place. Once cemented in place, the filter cake may be removed for production to occur, or alternatively for injection to take place if the well is an injection well. The production or injection may include fluid flow through the collar, sleeve, plug or tube as well as through the casing or liner. Alternatively, production or injection would take place through a pathway that supplants the barrier, collar, sleeve, plug or tube, such as formed from cement or other suitable material. A typical approach would be to pump chemicals through or adjacent to the barrier, collar, sleeve, plug or tube, to act as a solvent to dissolve the filter cake or sealing membranes. That is, the collar, sleeve, plug, tube or barrier is left in place to fall apart or disintegrate, rather than being removed whole. Concerns in such a process include, but are not necessarily limited to, the inability of the chemical to reach the filter cake itself, incomplete coverage of the filter cake or sealing membrane surface, loss of some or all chemical to the formation through the pathways that do open up, and the formation of damaging residues in or on the reservoir. However, such concerns are greatly reduced in the method herein as compared to prior methods used since a degradation product of the barrier, sleeve or tube, etc. is locally placed next to the filter cake since the barrier, sleeve or tube is also locally placed downhole.

In one non-limiting embodiment, the sleeves, tubes or barriers include or are at least partially made of a degradable material that degrades or disintegrates into a product or substance that optionally in turn removes the filter cake or membrane between the sleeve or tube and the wellbore wall. This method would further eliminate and/or minimize many of the problems previously mentioned. It will be further appreciated that when the barrier is in place to perform its blocking function, that it is not strictly necessary for the barrier to seal or make liquid-tight the flow pathway for it to effectively function.

Suitable degradable materials for the sleeves, tubes or barriers include, but are not necessarily limited to biodegradable polymers that degrade into acids. One such polymer is PLA (polylactide) polymer 4060D from NATURE-WORKS™, a division of Cargill Dow LLC. This polymer decomposes to lactic acid with time and temperature, which not only dissolves the filter cake trapped between the sleeve, tube or barrier and the borehole wall, but can stimulate the near flow pathway area of the formation as well. TLF-6267 polyglycolic acid from DuPont Specialty Chemicals is another polymer that degrades to glycolic acid with the same functionality. Other polyester materials such as polycaprolactams and mixtures of PLA and PGA degrade in a similar manner and would provide similar filter cake removing functionality. Solid acids, for instance sulfamic acid, trichloroacetic acid, and citric acid, in non-limiting examples, held together with a wax or other suitable binder material such as polyvinyl alcohols and polyvinyl acetates would also be suitable. In the presence of a liquid and/or temperature the binder would be dissolved or melted and the solid acid particles liquefied and already in position to locally contact and remove the filter cake from the wellbore face and to acid stimulate the portion of the formation local to the flow pathway. Polyethylene homopolymers and paraffin waxes are also expected to be useful materials for the degradable barriers in the method described herein. Products from the degradation of the barrier include, but are not necessarily limited to acids, bases, alcohols, carbon dioxide, combinations of these and the like. Again, it should be appreciated that these temporary barriers degrade or disintegrate in place, as contrasted with being removed whole. The temporary barriers herein should not be confused with conventional cement or polymer plugs used in wells.

There are other types of materials that can function as barriers or plugs and that can be controllably removed. Polyalkylene oxides, such as polyethylene oxides, and polyalkylene glycols, such as polyethylene glycols, are some of the most widely used in other contexts. These polymers are slowly soluble in water. The rate or speed of solubility is dependent on the molecular weight of these polymers. Acceptable solubility rates can be achieved with a $M_w$ molecular weight range of 100,000 to 7,000,000. Thus, solubility rates for a temperature range of from about 50° to about 200° C. can be designed with the appropriate molecular weight or mixture of molecular weights.

The delayed degradation material layer is similar to, but may be different than the degradable barriers, sleeves or plugs described above. This may be because the delayed degradation material layer is expected in most cases to coat or be placed over the degradable barrier(s), but also over at least part of the flow conduit, if not substantially all of the exterior of the downhole filtration tool. One purpose of the delayed degradation material layer is to protect the tool and the degradable barrier(s) during run-in and placement of the tool. Some of the materials for the delayed degradation material layer may be the same as or different from those for the degradable barriers, plugs or sleeves. This is because it may not be necessary or desirable for the delayed degradation material layer to degrade or disintegrate into a product that in turn can remove a temporary coating, such as a filter cake. The downhole filtration tool may also be protected by a protective metal shroud over the dissolvable/degradable polymer film layer. Suitable metals for the metal shroud include, but are not necessarily limited to, carbon steel, stainless steel, corrosion resistant alloys, high nickel alloys, titanium alloys, and the like.

The delayed degradation material layer may include, but is not necessarily limited to, polyurethane, saturated polyesters, polyvinyl alcohols, low molecular weight polyethylenes, polylactic acid, polyglycolic acid, cellulose, polyamides, polyacrylamides, polyketones, derivatized cellulose, medium and high molecular weight silicones, and combinations thereof. Derivatized cellulose is defined to include, but not necessarily limited to, carboxymethylcellulose (CMC), hydroxyethylcellulose (HEC), polyanionic cellulose (PAC), carboxy-methylhydroxyethylcellulose (CMHEC), and combinations thereof. Medium molecular weight silicones are defined as those having a weight average ($M_w$) molecular weight of from about 10,000 to about 100,000, whereas high molecular weight silicones are defined as those having a weight average molecular weight of from about 100,000 to about 750,000. Particularly suitable low molecular weight polyethylenes include, but are not restricted to, POLYWAX® polyethylenes having a number average molecular weight of between about 450 and about 3000, available from Baker Petrolite.

In one non-limiting embodiment, the degradable material degrades over a period of time ranging from about 1 to about 240 hours. In an alternative, non-limiting embodiment the period of time ranges from about 1 to about 120 hours, alternatively from 1 to 72 hours. The delayed degradation material layer would degrade at a rate slower than the degradable material under the same conditions, for instance from about 1 to about 480 hours, alternatively from about 1 to about 120 hours. This is so that the delayed degradation material layer will serve to protect the degradable barriers during run-in and placement of the downhole tool and prevent premature degradation of the degradable barriers. In another non-limiting embodiment, the degradable material degrades over a temperature range of from about 50° to about 200° C. In an alternative, non-limiting embodiment the temperature may range from about 50° to about 150° C. Alternatively, the lower limit of these ranges may be about 80° C. Of course, it will be understood that both time and temperature can act together to degrade the degradable material and the delayed degradation material layer. And certainly the use of water, as is commonly used in drilling or completion fluids, or some other chemical, could be used alone or together with time and/or temperature as a solvent to dissolve or otherwise degrade the material. Other fluids or chemicals that may be used include, but are not necessarily limited to alcohols, mutual solvents, fuel oils such as diesel, and the like. In the context herein, the degradable barrier is considered substantially soluble in the fluid if at least half of the barrier or delayed degradation material layer is soluble therein or dissolves therein. It may thus be appreciated that a method herein may take an active step to degrade the delayed degradation material layer and/or the degradable barrier, thereby causing their degradation or disintegration. It may also be appreciated that in some non-restrictive versions the delayed degradation material layer and/or degradable barrier are allowed to degrade, in a non-limiting example over time with temperature, which would be a passive portion of the method.

It will be also understood that the method and apparatus herein is considered successful if the degradable material disintegrates or degrades sufficiently to generate a product that will remove sufficient filter cake to permit flow through the pathway. That is, the method is considered effective even if not all of the degradable material disintegrates, degrades, dissolves or is displaced and/or not all of the filter cake across the fluid pathway is removed. Similarly, the apparatus and method herein may be considered successful if not all of the delayed degradation material layer degrades, dissolves or is otherwise removed from the tool, such as from an exterior of the tool. In an alternative, non-limiting embodiment, the method and apparatus are considered successful if at least 50% of the degradable material and/or delayed degradation material layer is disintegrated and/or at least 50% of the filter cake across or within the fluid pathway is removed, and in yet another non-limiting embodiment if at least 90% of either material in the flow pathway is disintegrated, removed or otherwise displaced. Any of these rates of removal may be considered "substantial removal" in the context of the apparatus and methods herein.

The apparatus and method will now be described more specifically with respect to the Figures, where in FIG. 1 there is shown the cross-section of a vertically oriented, downhole filtration tool 32 having a flow conduit 10 having an orifice 12 on either side thereof. Certainly tool 32 may have more orifices 12 than two orifices. The orifice 12 may be created by a perforating gun, by machining prior to run-in of the casing to the well or other suitable technique. The downhole tool 32 is placed in a borehole 14 having walls 16 through a subterranean reservoir 20 (also termed a flow source herein, but may also be considered a flow target in the embodiment of a water flood operation or the like). The borehole wall 16 may have a filter cake 22 thereon as may be deposited by a drilling fluid or, more commonly, a drill-in fluid. Filter cake 22 deposition is a well known phenomenon in the art. Filter cake 22 (also known as a temporary coating) prevents the unwanted flow of liquids into the formation and must be removed prior to the flow of hydrocarbons from subterranean formation 20, or the injection of water into the formation 20.

Collars, sleeves, barriers or tubes 18 are provided between the orifices 12 and the filter cake 22. It is these sleeves, tubes or plugs 18 that are made, at least in part, of the degradable barrier material. In the non-limiting embodiment shown in FIGS. 1 and 2, the degradable barriers 18 are hollow. In another non-limiting embodiment, these hollow sleeves may be at least partially filled with a specially sized gravel pack material or other sand control media. In an alternate non-limiting embodiment, the degradable barriers 18 are solid and not hollow. It is expected that the barriers, collars, sleeves or tubes 18 are generally cylindrical in shape and have a circular cross-section, due to ease of manufacture, but this is not a requirement of, or critical to, the apparatus or method herein.

Figure 2:
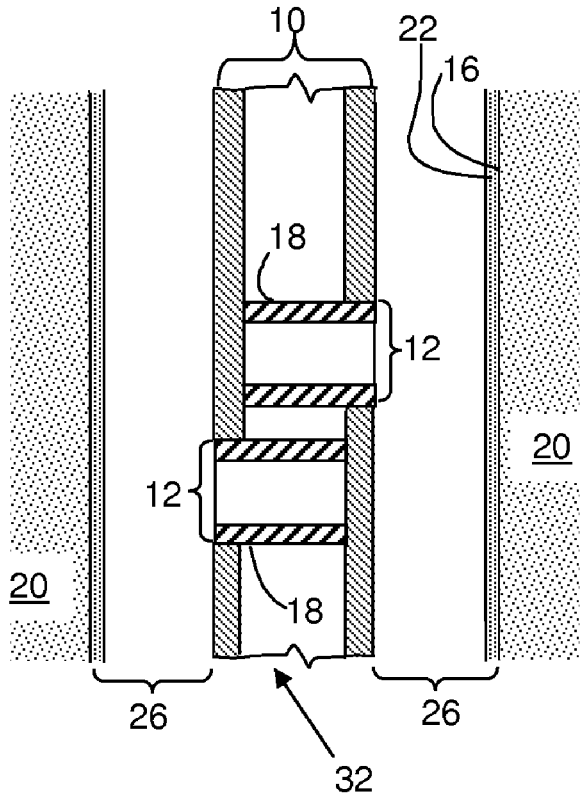
FIG. 2 is a cross-section schematic view of an oil well casing or conduit in a borehole having two degradable barriers, sleeves or tubes in contracted or indrawn position on either side of the casing, where a delayed degradation material layer over or covering the degradable barriers, as well as at least part of the casing of FIG. 1, has been removed, and where a filter cake (temporary coating) is present on the borehole walls.

The exterior of downhole tool 32 is coated, covered or provided with delayed degradation material layer 30, delayed degradation material layer 30 at least covers degradable barriers 18. Such layer 30 is intended to protect the tool 32 and particularly the degradable barriers 18 during run-in and placement of the tool 32 in the borehole 14. There may also be present an optional metal shroud (not shown) over the delayed degradation material layer 30. After placement of the tool 32 as shown in FIG. 1, the delayed degradation material layer 30 is removed, dissolved or otherwise degraded as previously described, as shown in FIG. 2.

In an optional embodiment, the barriers, sleeves or tubes 18 are extended, telescoped or moved outward from the interior of the flow conduit 10 to the bore hole walls 16 (reservoir face) or to the temporary coating (filter cake). This extension or expansion may be done by hydraulic pressure or other technique.

The sleeves 18 are surrounded and fixed in place (but not made permanent, in the embodiment where they are degradable) by cement 24 introduced into the annulus 26 of the well. It may be understood that cement 24 (or other suitable rigid material, e.g. a non-biodegradable polymer different from degradable barriers 18) forms a pathway around each barrier 18 that is more evident and functional once the barrier 18 is removed. Optionally, if the sleeves or tubes 18 are not degradable, such as in the TELEPERF™ technology available from Baker Oil Tools, perforation and/or cementing may be avoided.

Figure 3:
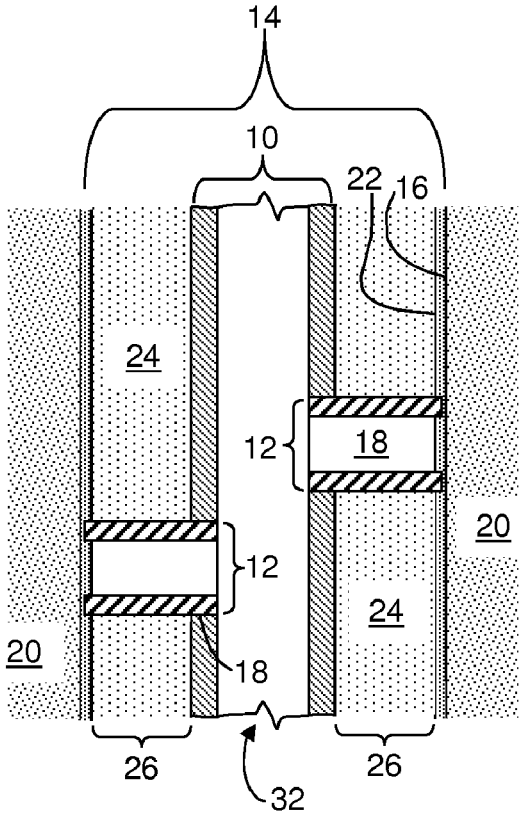
FIG. 3 is a cross-section schematic view of an oil well casing or conduit in a borehole after the delayed degradation material layer has been degraded, where the two barriers, sleeves or tubes, one on either side of the casing, each reach or extend from an orifice in the casing to the filter cake on the borehole wall and cement has been introduced into the annulus.
Figure 4:
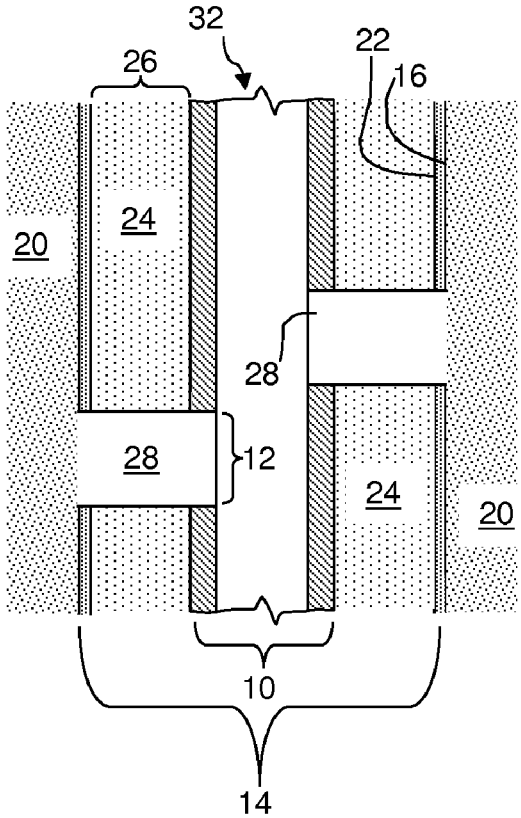
FIG. 4 is a cross-section schematic view of an oil well casing in a borehole having two flow pathways on either side thereof, where the barriers, sleeves or tubes have been disintegrated or degraded and the filter cake on the borehole wall adjacent to the reservoir removed.

Between FIGS. 3 and 4, the degradable material of collars, barriers, sleeves or tubes 18 is degraded or disintegrated through a mechanism such as heat, the passage of a sufficient amount of time, e.g. a few hours, or a combination thereof. As noted, optionally the degradable barriers 18 degrade or disintegrate into at least one product, such as an acid or other agent that in turn removes the filter cake 22 from adjacent the former location of the barrier 18. The resulting structure would appear schematically similarly to FIG. 4 where flow pathways 28 are left through the cement 24 between the orifices 12 and the formation 20. After this point, the well would be ready to be produced (hydrocarbons flowing through pathways 28 from the formation 20 into the casing 10), or the well would be ready to have water injected in the direction from the casing 10 through flow pathways 28 into the formation 20.

While barriers or sleeves 18 could be degraded by the application of a liquid, such as an acid or other chemical or solvent, it should be understood that one difficulty with doing so is getting the liquid to distribute effectively through the entire length of the casing. An important advantage of the method herein is that when the barriers 18 degrade, the product is locally formed and directly delivered at many sites along the length of the borehole 14. If a liquid such as an acid or other agent is delivered downhole to dissolve or degrade the barriers 18, filter cake 22 next to the barrier 18 would likely also be removed and the liquid would be free to leak off into the formation 10, instead of continuing down the casing 10 to subsequent barrier 18. This technique is an improvement over trying to deliver an acid or other agent from the surface to be distributed at many locations evenly along the wellbore. Typically, the amount of agent delivered diminishes with distance.

It is expected that the delayed degradation material layer and/or a metal shroud would serve as a protective coating on delicate or sensitive parts of downhole tools, as well as to prevent or inhibit premature or uncontrolled degradation of the degradable barriers in the orifices of the flow conduit. A coating, layer or film could be applied on the outer surface or exterior of the downhole filtration tool and serve as such protection until the tool is in place in the well. The removal mechanism(s) would then be activated to place the tool into service. For instance, sand control screens and other downhole filtration tools could be coated to prevent plugging while running in the hole, thereby enhancing the gravel placement to prevent voids from forming and dissolving filter cakes on open hole wellbores.

As previously discussed, the removal mechanism could include, but is not necessarily limited to heat, time, the application of a chemical or solvent such as water, and the like. These types of coatings could be used to control the release of chemicals or activate a downhole switch such as upon the influx of water into the production stream. This technology could be used to place temporary plugs into orifices that stay closed until water (or other agent) dissolves or degrades them. Downhole hydraulic circuits could also be constructed for "intelligent" well completion purposes. In general, these polymers and other temporary, degradable materials could be applied to any situation where isolation from well fluids is desired until a known or predetermined event occurs to remove them.

It will be appreciated that temporary barriers and degradation material layers could find utility on or within mechanisms at remote locations other than subterranean reservoirs. Such other remote locations include, but are not necessarily limited to, the interior of remote pipelines, subsea locations, polar regions, spacecraft, satellites, extraterrestrial planets, moons and asteroids, and within biological organisms, such as human beings (on a micro- or nano-scale), and the like.

Thus, the apparatus and methods discussed herein provide a method for temporarily blocking a flow pathway, where the temporary barrier and delayed degradation material layer may be easily removed. Further, in some embodiments a temporary barrier and temporary coating may be used, where a first component or barrier disintegrates or degrades into a product that removes the second barrier or coating, such as a filter cake.

In the foregoing specification, the invention has been described with reference to specific embodiments thereof, and has been demonstrated as expected to be effective in providing a method of facilitating flow of hydrocarbons or the injection of water (or other liquids) into subterranean formations. However, it will be evident that various modifications and changes can be made to the apparatus, compositions and methods without departing from the broader spirit or scope of the invention as set forth in the appended claims. Accordingly, the specification is to be regarded in an illustrative rather than a restrictive sense. For example, specific combinations of delayed degradation material layers, degradable materials, degradation products, filter cake materials, degradation mechanisms and other components falling within the claimed parameters, but not specifically identified or tried in a particular composition or under specific conditions, are anticipated to be within the scope of this invention.

The present invention may suitably comprise, consist or consist essentially of the elements disclosed and may be practiced in the absence of an element not disclosed.

The words "comprising" and "comprises" as used throughout the claims is to interpreted "including but not limited to".

What is claimed is:

1. A downhole filtration tool comprising:

a flow conduit comprising a plurality of orifices;

a degradable barrier in the orifices, where the degradable barrier degrades into at least one product selected from the group consisting of acids, bases, alcohols, carbon dioxide and combinations thereof; and a delayed degradation material layer over the degradable barrier, where delayed degradation material layer is different from the degradable barrier and degrades at a rate slower than the degradable barrier;

where the product is removing a material selected from the group consisting of a temporary coating, formation damaging debris, mud that has invaded the formation, and combinations thereof and the degradable barrier and the delayed degradation material layer are different than the material.

2. The downhole filtration tool of claim 1 where the downhole filtration tool is a sand control screen.

3. The downhole filtration tool of claim 1 where the degradable barrier and the delayed degradation material layer are degradable by a mechanism selected from the group consisting of:

biodegradation;

heating it to a temperature in the range between about 50 and about 200° C.;

contacting it with a fluid in which the degradable barrier is substantially soluble;

passage of time; and combinations thereof.

4. The downhole filtration tool of claim 3 where the degradable barrier and the delayed degradation material layer degrade by different mechanisms.

5. The downhole filtration tool of claim 1 where:

the degradable barrier is selected from the group consisting of polylactic acid, polycaprolactams, polyglycolic acid, polyvinyl alcohols, polyalkylene oxides, polyalkylene glycols, polyethylene homopolymers, paraffin waxes comprising solid acids, materials comprising solid acid particles, and combinations thereof; and the delayed degradation material layer is selected from the group consisting of polyurethane, saturated polyesters, polyvinyl alcohols, polyethylenes, polylactic acid, polyglycolic acid, cellulose, polyamides, polyacrylamides, polyketones, derivatized celluloses, and silicones having a weight average molecular weight in the range of from about 10,000 to about 750,000 and combinations thereof.

6. The downhole filtration tool of claim 1 where the delayed degradation material layer covers at least a portion of an exterior of the flow conduit as well as the degradable barrier in the orifices.

7. A downhole filtration tool comprising:

a flow conduit comprising a plurality of orifices;

a degradable barrier in the orifices, where the degradable barrier is selected from the group consisting of polylactic acid, polycaprolactams, polyglycolic acid, polyvinyl alcohols, polyalkylene oxides, polyalkylene glycols, polyethylene homopolymers, paraffin waxes comprising solid acids, materials comprising solid acid particles, and combinations thereof, and where the degradable barrier degrades into at least one product selected from the group consisting of acids, bases, alcohols, carbon dioxide and combinations thereof; and a delayed degradation material layer over the degradable barrier, where the delayed degradation material layer is different from the degradable barrier and is selected from the group consisting of polyurethane, saturated polyesters, polyvinyl alcohols, polyethylenes, polylactic acid, polyglycolic acid, cellulose, polyamides, polyacrylamides, polyketones, derivatized celluloses, and silicones having a weight average molecular weight in the range of from about 10,000 to about 750,000 and combinations thereof, and where the delayed degradation material layer degrades at a rate slower than the degradable barrier;

where the product is removing a material selected from the group consisting of a temporary coating, formation damaging debris, mud that has invaded the formation, and combinations thereof and the degradable barrier and the delayed degradation material layer are different than the material.

8. The downhole filtration tool of claim 7 where the downhole filtration tool is a sand control screen.

9. The downhole filtration tool of claim 7 where the degradable barrier and the delayed degradation material layer are degradable by a mechanism selected from the group consisting of:

biodegradation;

heating it to a temperature in the range between about 50 and about 200° C.;

contacting it with a fluid in which the degradable barrier is substantially soluble;

passage of time; and combinations thereof.

10. The downhole filtration tool of claim 9 where the degradable barrier and the delayed degradation material layer degrade by different mechanisms.

11. The downhole filtration tool of claim 1 where the delayed degradation material layer covers at least a portion of an exterior of the flow conduit as well as the degradable barrier in the orifices.

12. A method for temporarily blocking a flow pathway comprising:

providing a flow conduit in the vicinity of a flow source or target, where the flow conduit comprises:

a plurality of orifices;

a degradable barrier in the orifices, where the degradable barrier degrades into at least one product selected from the group consisting of acids, bases, alcohols, carbon dioxide and combinations thereof; and a delayed degradation material layer over the degradable barrier, where delayed degradation material layer is different from the degradable barrier and degrades at a rate slower than the degradable barrier;

causing or allowing in any order:

the delayed degradation material layer to degrade;

the degradable barrier to degrade;

thereby forming a pathway between the orifice and the flow source or target;

where the product is removing a material selected from the group consisting of a temporary coating, formation damaging debris, mud that has invaded the formation, and combinations thereof and the degradable barrier and the delayed degradation material layer are different than the material.

13. The method of claim 12 where the downhole filtration tool is a sand control screen.

14. The method of claim 12 where the degradable barrier and the delayed degradation material layer are degradable by a mechanism selected from the group consisting of:

biodegradation;

heating the degradable barrier and the delayed degradation material layer to a temperature in the range between about 50 and about 200° C.;

contacting the degradable barrier and the delayed degradation material layer with a fluid in which the degradable barrier is substantially soluble;

the passage of time; and combinations thereof.

15. The method of claim 14 where the degradable barrier and the delayed degradation material layer degrade by different mechanisms.

16. The method of claim 12 where:

the degradable barrier is selected from the group consisting of polylactic acid, polycaprolactams, polyglycolic acid, polyvinyl alcohols, polyalkylene oxides, polyalkylene glycols, polyethylene homopolymers, paraffin waxes comprising solid acids, materials comprising solid acid particles, and combinations thereof; and the delayed degradation material layer is selected from the group consisting of polyurethane, saturated polyesters, polyvinyl alcohols, polyethylenes, polylactic acid, polyglycolic acid, cellulose, polyamides, polyacrylamides, polyketones, derivatized celluloses, and silicones having a weight average molecular weight in the range of from about 10,000 to about 750,000 and combinations thereof.

17. The method of claim 16 where the flow conduit is a well casing or liner and the flow source is a subterranean formation and the method is a hydrocarbon recovery operation.

18. A method for temporarily blocking and opening a flow path in and/or around a mechanism comprising:

forming a degradable barrier in at least part of a plurality of orifices in a mechanism, where the degradable barrier degrades into at least one product selected from the group consisting of acids, bases, alcohols, carbon dioxide and combinations thereof forming a delayed degradation material layer over the degradable barrier and at least part of the mechanism, where the delayed degradation material layer is different from the degradable barrier and;

placing the blocked mechanism at a remote location; and causing or allowing the degradable barrier and the delayed degradation material layer to degrade;

where the product is removing a material selected from the group consisting of a temporary coating, formation damaging debris, mud that has invaded the formation, and combinations thereof and the degradable barrier and the delayed degradation material layer are different than the material.

19. The method of claim 18 where the mechanism is a downhole tool.

20. The method of claim 19 where the downhole tool is a downhole filtration tool.

21. The method of claim 18 where the degradable barrier and the delayed degradation material layer are degradable by a mechanism selected from the group consisting of:

biodegradation;

heating the degradable barrier and the delayed degradation material layer to a temperature in the range between about 50 and about 200° C.;

contacting the degradable barrier and the delayed degradation material layer with a fluid in which the degradable barrier is substantially soluble;

the passage of time; and combinations thereof.

22. The method of claim 21 where the degradable barrier and the delayed degradation material layer degrade by different mechanisms.

23. The method of claim 18 where:

the degradable barrier is selected from the group consisting of polylactic acid, polycaprolactams, polyglycolic acid, polyvinyl alcohols, polyalkylene oxides, polyalkylene glycols, polyethylene homopolymers, paraffin waxes comprising solid acids, materials comprising solid acid particles, and combinations thereof; and the delayed degradation material layer is selected from the group consisting of polyurethane, saturated polyesters, polyvinyl alcohols, polyethylenes, polylactic acid, polyglycolic acid, cellulose, polyamides, polyacrylamides, polyketones, derivatized celluloses, and silicones having a weight average molecular weight in the range of from about 10,000 to about 750,000 and combinations thereof.

* * * * *